US008727491B2

(12) United States Patent
Watanabe

(10) Patent No.: US 8,727,491 B2
(45) Date of Patent: May 20, 2014

(54) FLUID EJECTING APPARATUS

(75) Inventor: Eiichiro Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 548 days.

(21) Appl. No.: 12/776,542

(22) Filed: May 10, 2010

(65) Prior Publication Data

US 2010/0283815 A1 Nov. 11, 2010

(30) Foreign Application Priority Data

May 11, 2009 (JP) ..... 2009-114701

(51) Int. Cl.
*B41J 2/165* (2006.01)

(52) U.S. Cl.
USPC ..... 347/35

(58) Field of Classification Search
None
See application file for complete search history.

(56) References Cited

U.S. PATENT DOCUMENTS

| | | | | |
|---|---|---|---|---|
| 5,381,168 | A | 1/1995 | Kondo et al. | |
| 5,917,513 | A * | 6/1999 | Miyauchi et al. | 347/29 |
| 6,550,885 | B2 | 4/2003 | Matsumoto et al. | |
| 2008/0143779 | A1 | 6/2008 | Yoshida | |
| 2008/0192085 | A1 * | 8/2008 | Shimazaki | 347/35 |
| 2008/0316254 | A1 * | 12/2008 | Byun | 347/36 |

FOREIGN PATENT DOCUMENTS

| | | |
|---|---|---|
| JP | 05-305714 | 11/1993 |
| JP | 2001-191557 | 7/2001 |
| JP | 2002-086759 | 3/2002 |
| JP | 2002-137415 | 5/2002 |
| JP | 2007-326284 | 12/2007 |
| JP | 2008-149628 | 7/2008 |
| JP | 2008-246831 | 10/2008 |
| JP | 2009-137210 | 6/2009 |

* cited by examiner

*Primary Examiner* — Alejandro Valencia
(74) *Attorney, Agent, or Firm* — Workman Nydegger

(57) ABSTRACT

A fluid ejecting apparatus includes a fluid ejecting head that has a nozzle formation surface and ejects fluid from a nozzle formed as a hole through the nozzle formation surface. A fluid catching unit has an opening that faces the nozzle formation surface of the fluid ejecting head at the time of flushing, as waste fluid is ejected from the nozzle of the fluid ejecting head. The fluid catching unit receives the waste fluid ejected from the nozzle through the opening. A cover mechanism includes a cover member that moves between cover retracted positions. At the cover position, the cover member can close the opening of the fluid catching unit. At the retracted position, the cover member cannot close the opening during the flushing. Negative pressure is generated inside the fluid catching unit when the cover member is positioned at the cover position.

6 Claims, 5 Drawing Sheets

FLUID EJECTING APPARATUS

BACKGROUND

1. Technical Field

The present invention relates to a fluid ejecting apparatus that is provided with a fluid ejecting head for ejecting fluid.

2. Related Art

An ink-jet printer is known as an example of various kinds of fluid ejecting apparatuses. An ink-jet printer ejects ink (fluid) onto a recording target medium such as a sheet of printing paper (target medium) from a recording head, which is an example of a fluid ejecting head. Such an ink-jet printer is hereinafter simply referred to as "printer". When the non-ejection state of a printer, which is a state in which no ink is ejected from the nozzles of a recording head, continues for a long period of time, the surface of meniscus of ink retained inside the nozzles becomes dried. In such a case, there is a risk that the ink-ejection performance of a printer might deteriorate. In order to avoid poor ink ejection, a printer performs so-called flushing operation. In flushing, ink is forcibly discharged through nozzles on the basis of a control signal during a time period in which printing is not performed. This control signal is not related to printing operation.

For example, a serial printer or a lateral printer, which ejects ink from a recording head that moves in reciprocating motion along a plane over which a sheet of recording paper is transported during printing, performs flushing as follows. The serial/lateral printer causes the recording head to move to a non-printing area, which is located outside an area where printing is performed on a sheet of recording paper. A fluid catching unit, which is a catcher for receiving fluid, is provided at the non-printing area. Examples of the fluid catching unit are: a cap, a flushing box, or the like. The printer ejects ink as an example of fluid into the fluid catching unit for the purpose of flushing. A line head printer, which is equipped with a line-type recording head that does not move along a plane over which a sheet of recording paper is transported and is provided at somewhere over a paper transportation path in such a manner that the recording head extends throughout the entire width of the sheet in a direction that is orthogonal to the transportation direction of recording paper, performs flushing as follows. A fluid catching unit such as a cap or the like is configured as a movable member. The line head printer moves the fluid catching unit to a position where the fluid catching unit faces the nozzle formation surface of the recording head at the proximity thereof or in contact therewith. With the fluid catching unit facing the nozzle formation surface of the recording head, the printer ejects ink into the fluid catching unit for the purpose of flushing.

A part of an ink droplet discharged as waste ink into a fluid catching unit such as a cap or the like during flushing operation is formed into mist particles and floats inside the fluid catching unit. Such misty ink (hereinafter may be referred to as "ink mist") sometimes floats out of the fluid catching unit through an opening that is formed as a part of the fluid catching unit. The opening of the fluid catching unit is an open region that is positioned opposite to a recording head during flushing operation. As an example of printers of late that are equipped with a mechanism for preventing the floating of ink mist to the outside of a fluid catching unit, a printer that is disclosed in JP-A-2001-191557 or JP-A-2002-137415 has been proposed in the art.

The related-art printer that is disclosed in the above patent documents is equipped with a negative pressure generating means that is connected to a fluid catching unit. An example of the negative pressure generating means is a suction pump.

The negative pressure generating means operates to apply a suction force to the inside of the fluid catching unit during flushing operation. The internal pressure of the fluid catching unit becomes negative because of suction. Since the negative pressure generating means generates negative pressure inside the fluid catching unit during flushing operation, ink ejected from a recording head as waste ink is sucked by the negative pressure generating means together with air that flows into the fluid catching unit through the opening. Therefore, even when a part of an ink droplet discharged from the recording head as waste ink into the fluid catching unit turns into ink mist, the disclosed mechanism makes it possible to prevent the ink mist from floating out of the fluid catching unit.

The opening of the fluid catching unit is open not only during flushing operation but also during a time period in which flushing is not performed. Therefore, at the time of flushing, the negative pressure generating means sucks not only ink ejected from the recording head as waste ink into the fluid catching unit but also air that flows/flowed into the fluid catching unit through the opening. For this reason, the disclosed printer has a disadvantage in that the burden of the negative pressure generating means is inevitably heavy because it requires extra power due to and corresponding to the greater suction amount of air entering the fluid catching unit through the opening, which is a problem that remains to be solved.

SUMMARY

An advantage of some aspects of the invention is to provide a fluid ejecting apparatus that is capable of reducing the burden of a negative pressure generating section. In addition to such load reduction, the fluid ejecting apparatus prevents misty fluid, which is some part of fluid that has been ejected from a fluid ejecting head as waste fluid into a fluid catching section for flushing and has formed into mist particles or the like, from floating out of the fluid catching section.

In order to address the above-identified problem without any limitation thereto, a fluid ejecting apparatus according to an aspect of the invention includes: a fluid ejecting head that has a nozzle formation surface and ejects fluid from a nozzle that is formed as a hole through the nozzle formation surface; a fluid catching section that has an opening that faces the nozzle formation surface of the fluid ejecting head at the time of flushing, which is ejection of the fluid from the nozzle of the fluid ejecting head as waste fluid, the fluid catching section receiving the fluid that has been ejected from the nozzle as the waste fluid and enters through the opening; a cover mechanism that includes a cover member that can move between two positions, which are a cover position and a retracted position, the cover position being a position at which the cover member can close or closes the opening of the fluid catching section, the retracted position being a position at which the cover member can not or does not close the opening during the flushing; a negative pressure generating section that generates negative pressure inside the fluid catching section when the cover member is positioned at the cover position; and a moving section that moves the fluid ejecting head and/or the fluid catching section relative to each other in a direction in which the fluid ejecting head and the fluid catching section approach each other and in a direction in which the fluid ejecting head and the fluid catching section become distanced from each other.

The fluid ejecting apparatus having the above configuration operates as follows. The cover member closes the opening of the fluid catching section during a time period in which flushing is not performed. In addition, the internal pressure of the fluid catching section becomes negative due to the operation of the negative pressure generating section during non-flushing operation. That is, when the negative pressure generating section operates, the cover member prevents air from flowing into the fluid catching section from the outside through the opening. Therefore, in comparison with a case where the negative pressure generating section operates with the opening not being closed by the cover member, the burden of the negative pressure generating section can be made lighter.

The cover member moves from the cover position to the retracted position during flushing operation on the basis of relative movement of the fluid ejecting head and the fluid catching section in a direction in which the fluid ejecting head and the fluid catching section approach each other. In this cover-retracted state, the fluid ejecting head ejects fluid as waste fluid. The ejected fluid passes through the opening to enter the fluid catching section, which means that the fluid catching section receives the fluid. The fluid catching section has been put into a negative pressure state as a result of the operation of the negative pressure generating section, which was performed when the cover member closed the opening. Therefore, the internal pressure of the fluid catching section is lower than pressure outside the fluid catching section when the fluid is ejected for flushing. In addition, the fluid ejecting head and/or the fluid catching section is/are moved relative to each other in a direction in which the fluid ejecting head and the fluid catching section become distanced from each other after the completion of flushing. As a result of this relative movement, the cover member closes the opening of the fluid catching section. Therefore, flushing is carried out while the internal pressure of the fluid catching section is lower than pressure outside the fluid catching section. For this reason, it is possible to prevent misty fluid, which is some part of fluid that has been ejected from the fluid ejecting head as waste fluid into the fluid catching section and has formed into (i.e., turned into) mist particles or the like, from floating out of the fluid catching section through the opening. Thus, a fluid ejecting apparatus according to the above aspect of the invention is capable of reducing the burden of the negative pressure generating section, and in addition, prevents such misty part of the fluid (waste fluid) ejected from the fluid ejecting head into the fluid catching section for flushing from floating out of the fluid catching section.

In the configuration of a fluid ejecting apparatus according to the above aspect of the invention, it is preferable that the fluid ejecting head should have a plurality of nozzles formed as holes through the nozzle formation surface, where the plurality of nozzles includes the nozzle mentioned above; the opening of the fluid catching section should be shaped to correspond to not all but some of the nozzles of the fluid ejecting head; and the fluid ejecting head should eject the fluid as the waste fluid not from all nozzles but from nozzles that currently face the opening at the time of the flushing.

In such a preferred configuration, the opening mentioned above is smaller in comparison with a case where the area size of an opening corresponds to all of the plurality of nozzles. Therefore, in comparison with such an opening whose area size corresponds to all nozzles, it is harder for air to flow into the fluid catching section from the outside through the opening when the cover member moves to the retracted position. For this reason, the internal pressure of the fluid catching section is kept lower than outside pressure during flushing operation even when flushing is carried out with the cover member being retracted after the operation of the negative pressure generating section with the opening being closed by the cover member for rendering the internal pressure of the fluid catching section negative. Thus, it is possible to prevent misty fluid, which is some part of fluid that has been ejected from the fluid ejecting head as waste fluid into the fluid catching section and has formed into mist particles or the like, from floating out of the fluid catching section through the opening.

In the preferred configuration, it is further preferable that the fluid ejecting head should have a plurality of nozzle groups each of which is made up of at least one nozzle; the opening of the fluid catching section should be shaped to correspond to not all of the nozzles of the fluid ejecting head but some nozzles that belong to a single nozzle group; the fluid ejecting head should eject the fluid as the waste fluid not from all of the nozzles of the fluid ejecting head but from nozzles that belong to a nozzle group that currently faces the opening at the time of the flushing; the moving section should move the fluid ejecting head and/or the fluid catching section relative to each other so as to change the nozzle group that currently faces the opening from one nozzle group to another after the ejection; and the fluid ejecting head should eject the fluid as the waste fluid not from all of the nozzles of the fluid ejecting head but from nozzles that belong to a nozzle group that currently faces the opening after the relative movement for the nozzle group change.

In such a preferred configuration, during flushing operation, a single nozzle group that faces the opening is changed in a sequential manner, which means that, for example, the nozzle groups of the fluid ejecting head are positioned to face the opening sequentially. The fluid ejecting head ejects fluid as waste fluid from nozzles that belong to a nozzle group that has now reached the facing position due to movement, that is, the position at which a single nozzle group (i.e., this nozzle group) faces the opening. Therefore, flushing performance is satisfactorily high even with a configuration in which the fluid catching section has the opening that is shaped to correspond to (e.g., that has a size corresponding to) not all of the nozzles of the fluid ejecting head but some nozzles that belong to a single nozzle group.

In the configuration of a fluid ejecting apparatus according to the above aspect of the invention, it is preferable that the fluid ejecting head should be configured to be moved by the moving section in a predetermined scan direction; and the negative pressure generating section should include a pump unit that operates to generate negative pressure inside the fluid catching section in accordance with the movement of the fluid ejecting head in the predetermined scan direction during a time period in which the flushing is not performed.

In such a preferred configuration, the negative pressure generating section operates to render the internal pressure of the fluid catching section whose opening is (currently) closed by the cover member negative in accordance with the movement of the fluid ejecting head in the predetermined scan direction during non-flushing operation. A driving source that supplies power for moving the moving section functions also as (The moving section functions also as) a driving source that supplies power for actuating the negative pressure generating section. Therefore, it is not necessary to provide another driving source. Since an additional driving source is not necessary, it is possible to avoid an increase in the number of parts.

In the preferred configuration, it is further preferable that the fluid catching section should be provided at one side in the scan direction whereas the pump unit should be provided at the other side in the scan direction; and the pump unit should operate to generate negative pressure inside the fluid catching section when pressed by the fluid ejecting head moving toward the other side in the scan direction during the time period in which the flushing is not performed.

In such a preferred configuration, the fluid ejecting head that moves toward the other side in the scan direction presses the pump unit; and as a result, the internal pressure of the fluid catching section whose opening is closed by the cover member becomes negative. In addition, the fluid ejecting head moves away from the pump unit in the scan direction during flushing operation. Therefore, the negative pressure generating section does not operate when the cover member is moved from the cover position to the retracted position to open the opening of the fluid catching section. That is, the sucking of air entering the fluid catching section through the opening from the outside by the negative pressure generating section can be prevented. Therefore, it is possible to reduce the burden of the negative pressure generating section without fault.

The cover mechanism further includes: an urging section that applies an urging force to the cover member in a direction from the retracted position toward the cover position; and a transmitted portion that is formed as a portion of or provided on the cover member, motive power being transmitted to the transmitted portion on the basis of relative movement of the fluid ejecting head and the fluid catching section in a direction in which the fluid ejecting head and the fluid catching section approach each other.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to FIGS. 1 to 5, an ink-jet printer according to an exemplary embodiment of the invention will now be explained in detail. The ink-jet printer described below is a kind of a fluid ejecting apparatus according to an aspect of the invention. Note that the terms "anteroposterior direction" (e.g., "from-back-to-front" direction or, when viewed in the reverse orientation, "from-front-to-back" direction), "horizontal direction", and "vertical direction" that appear in the following description of this specification mean the forward/backward (front/back) direction, the leftward/rightward (left/right) direction, and the upward/downward (top/bottom) direction shown by arrows in FIG. 1, respectively. The "from-back-to-front" direction corresponds to the sub scan direction. The horizontal direction corresponds to the main scan direction.

Figure 1:
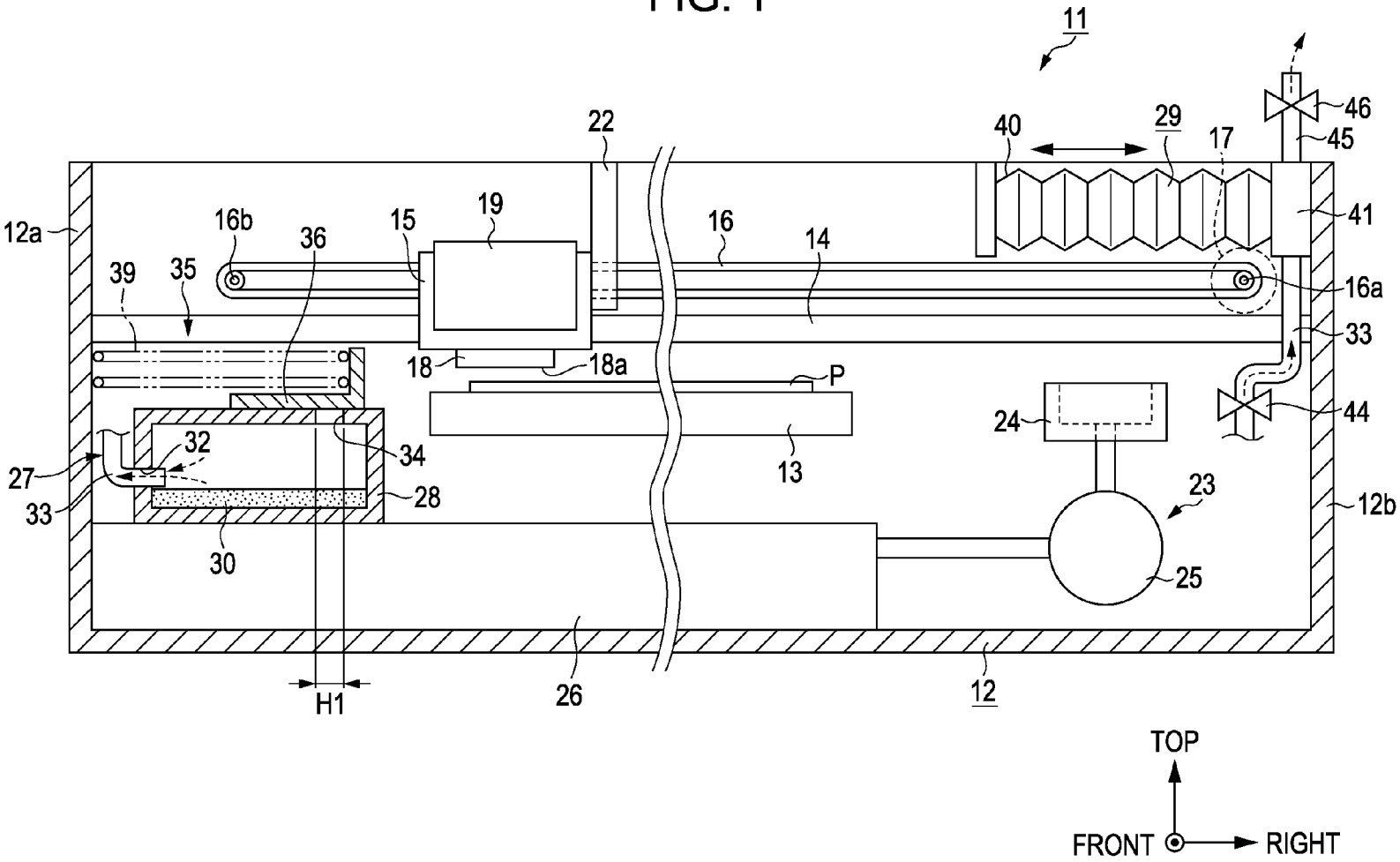
FIG. 1 is a diagram that schematically illustrates, in a sectional view, an example of the configuration of an ink-jet printer according to an exemplary embodiment of the invention.

As illustrated in FIG. 1, an ink-jet printer 11 according to the present embodiment of the invention is provided with a frame 12, which is a casing that has a substantially rectangular shape. A platen 13 is provided inside the frame 12 near the vertical center thereof. The platen 13 extends in the horizontal direction, which is the direction of the length of the frame 12. When driven by a paper-feeding motor that is not illustrated in the drawing, a paper-feeding mechanism that is also not illustrated in the drawing transports a sheet of recording paper P, which is an example of a target medium, to feed it onto the platen 13 from the back. The paper-feeding motor is provided at the lower part of the rear of the frame 12.

A guiding shaft 14 is provided inside the frame 12 over the platen 13. The guiding shaft 14 extends in the direction of the length of the platen 13. The guiding shaft 14 supports a carriage 15, which is an example of a moving section according to an aspect of the invention. The carriage 15 can move in reciprocating motion in the shaft line direction of the guiding shaft 14, which is the horizontal direction. The carriage 15 has a through hole that is formed in the horizontal direction. The hole formed through the carriage 15 is not illustrated in the drawing. The guiding shaft 14 is inserted through the hole. Because of such a structure, as explained above, the carriage 15 can move freely in reciprocating motion in the direction of the length of the guiding shaft 14.

A driving pulley 16*a* and a driven pulley 16*b* are provided on the inner surface of the rear of the frame 12 at positions corresponding to the ends of the guiding shaft 14. The driving pulley 16*a* and the driven pulley 16*b* can rotate freely. The power output shaft of a carriage motor 17 is connected to the driving pulley 16*a*. The carriage motor 17 functions as a driving source that supplies motive power for reciprocating the carriage 15. An endless timing belt 16 that is fixed to the carriage 15 is stretched between the pair of pulleys 16*a* and 16*b*. When the driving power of the carriage motor 17 is transmitted to the carriage 15 by means of the endless timing belt 16, the carriage 15 moves in the horizontal direction while being guided by the guiding shaft 14.

Figure 2:
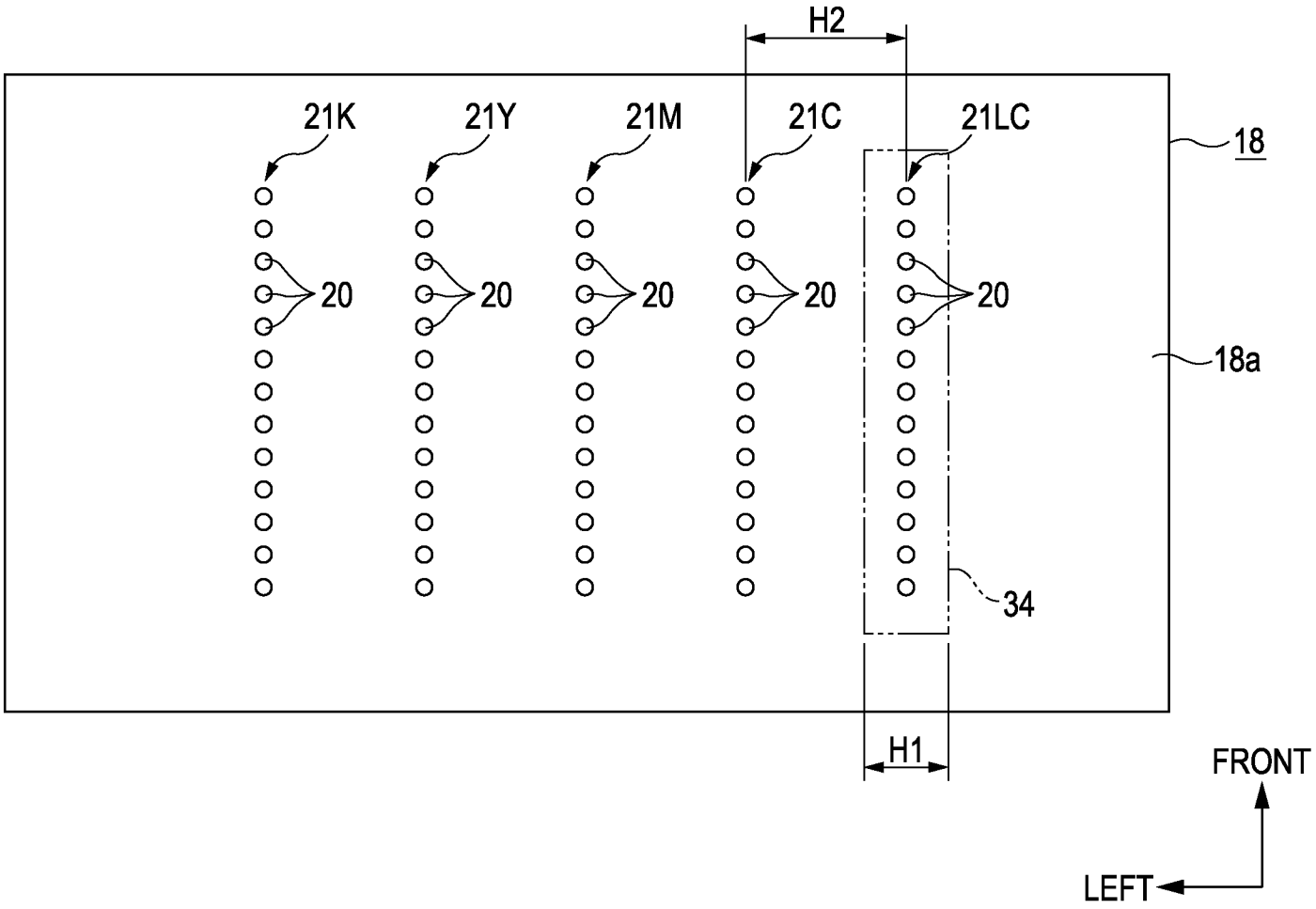
FIG. 2 is a plan view that schematically illustrates an example of the arrangement of nozzle groups formed through a nozzle formation surface according to an exemplary embodiment of the invention.

A recording head 18, which is an example of a fluid ejecting head according to an aspect of the invention, is mounted on the bottom face of the carriage 15. Ink cartridges 19 are detachably mounted on the carriage 15. The ink cartridges 19 contain ink of plural colors (i.e., types), which is to be supplied to the recording head 18. In the present embodiment of the invention, the ink cartridges 19 contain five types of ink. Ink is an example of fluid according to an aspect of the invention. For example, the ink cartridges 19 contain black ink, yellow ink, magenta ink, cyan ink, and light cyan ink, respectively. As illustrated in FIG. 2, the recording head 18 has a number of nozzles 20. A plurality of nozzles 20 is formed for each color of ink. The nozzles 20 are formed as openings through the nozzle formation surface 18*a* of the recording head 18. Specifically, as viewed from the left to the right in FIG. 2, a group of black ink nozzles 21K, a group of yellow ink nozzles 21Y, a group of magenta ink nozzles 21M, a group of cyan ink nozzles 21C, and a group of light cyan ink nozzles 21LC are formed through the nozzle formation surface 18*a* of the recording head 18. Each of the nozzle groups 21K, 21Y, 21M, 21C, and 21LC includes at least one nozzle line. The nozzle line is a line of the holes of the plurality of nozzles 20 that are arranged in the anteroposterior direction (i.e., from the front to the back or vice versa) at equal spaces. In the illustrated example of FIG. 2, thirteen nozzles 20 are aligned for each ink color. A piezoelectric element that is not illustrated in the drawing is provided for each of the plurality of nozzles 20. When the plurality of piezoelectric elements is driven, ink contained in the ink cartridge 19 is supplied to the plurality of nozzles 20 and then ejected downward through the respective holes of the nozzles 20.

As illustrated in FIG. 1, a pressing member 22 is provided on the carriage 15 according to the present embodiment of the invention. The pressing member 22 applies a rightward pressing force to an expandable and contractible member 40 of a pump unit 29 when the carriage 15 moves to the right. A more detailed explanation of the pressing member 22, the pump unit 29, and the expandable and contractible member 40 will be given later.

A non-printing area includes a home position, which is the standby position of the carriage 15 where the carriage 15 stays at the time of the maintenance of the recording head 18. The non-printing area is an area where a sheet of recording paper P does not pass through. The non-printing area is located near the right end inside the frame 12. When the movable carriage 15 stays at the home position, a maintenance unit 23 is provided under the carriage 15. The maintenance unit 23 performs various kinds of maintenance operations such as cleaning and the like for the purpose of keeping the good ink-ejection state of the recording head 18. Accordingly, the recording head 18 can always eject ink onto sheets of recording paper P with good ink-ejection performance.

The maintenance unit 23 includes a cap 24, a cap elevation mechanism that is not illustrated in the drawing, a suction pump 25, and a waste ink tank 26. The cap 24 is a member that has the shape of an open-topped box with a bottom. The cap elevation mechanism causes the cap 24 to move up and down. The suction pump 25 is capable of applying a suction force to the inside of the cap 24. The waste ink tank 26 is provided under the platen 13. The cap 24 is configured to, when the carriage 15 has moved to the home position, be brought into contact with the recording head 18 in such a manner that the cap 24 encloses and covers all of the holes of the nozzles 20 that are formed through the nozzle formation surface 18*a* of the recording head 18. The cap elevation mechanism is configured to lift the cap 24 up as the carriage 15 moves closer to the home position. The suction pump 25 is driven in a state in which the cap 24 is in contact with the recording head 18 when the carriage 15 stays at the home position. When the suction pump 25 is driven, negative pressure is generated inside the cap 24. Because of the negative pressure, ink is discharged through each nozzle 20 of the recording head 18 as waste ink, which is an example of waste fluid according to an aspect of the invention. After having been discharged into the cap 24 in this way, ink drains into the waste ink tank 26 through the suction pump 25.

The ink-jet printer 11 according to the present embodiment of the invention has another non-printing area, that is, an area where a sheet of recording paper P does not pass through, at the left end region inside the frame 12. The left non-printing area includes a flushing area. The recording head 18 performs flushing operation after the movement of the carriage 15 to the flushing area. Accordingly, the ink-jet printer 11 is provided with a flushing unit 27 as a unit that is separated from the maintenance unit 23. The flushing unit 27 includes a flushing box 28 and the pump unit 29. The flushing box 28 is provided at the flushing area. The flushing box 28 is an example of a fluid catching section according to an aspect of the invention. The pump unit 29 is provided over the maintenance unit 23. The pump unit 29 operates to put the internal pressure of the flushing box 28 into a negative pressure state.

The flushing box 28 has the shape of a hollow rectangular parallelepiped. The flushing box 28 is provided on the left side of the top of the waste ink tank 26. An ink absorbent material 30 that has a substantially rectangular shape is provided inside the flushing box 28. The ink absorbent material 30 absorbs ink ejected as waste ink into the flushing box 28 during flushing operation. A communication hole 32 is formed through the left sidewall of the flushing box 28. The communication hole 32 is formed above the upper surface of the ink absorbent material 30. A suction tube 33, which is connected to the pump unit 29, is inserted through the communication hole 32. Accordingly, the tip of the suction tube 33 is positioned inside the flushing box 28.

Figure 3:
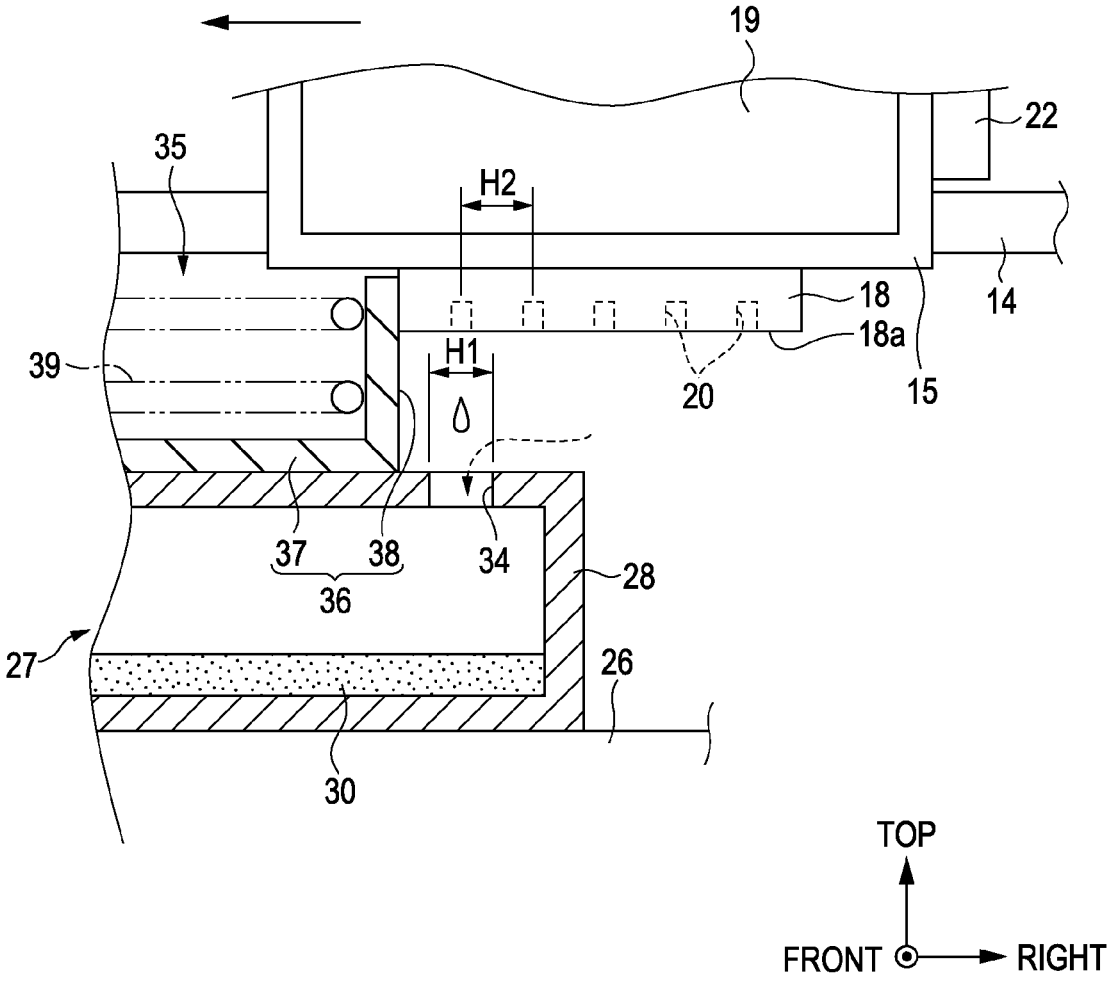
FIG. 3 is a diagram that schematically illustrates, in a sectional view, an example of pressing operation in which a cover member is pressed by a recording head according to an exemplary embodiment of the invention.
Figure 4:
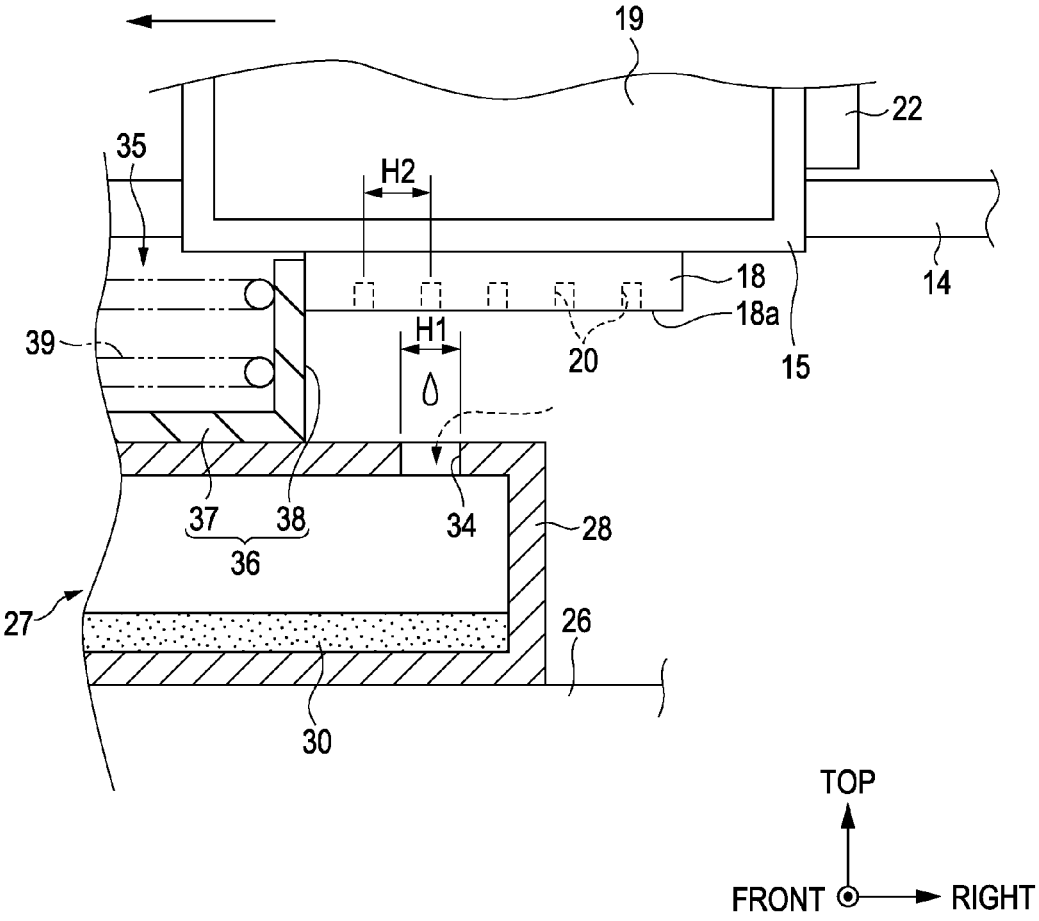
FIG. 4 is a diagram that schematically illustrates, in a sectional view, an example of pressing operation in which the cover member is pressed by the recording head according to an exemplary embodiment of the invention.

An opening 34 is formed through the top wall of the flushing box 28 at a region facing the nozzle formation surface 18*a* of the recording head 18 when the recording head 18 has moved to the flushing area. Ink ejected through the nozzles 20 of the recording head 18 passes through the opening 34 of the flushing box 28. As illustrated in FIGS. 3 and 4, the area size of the opening 34 corresponds to each of the nozzle groups 21K, 21Y, 21M, 21C, and 21LC (i.e., one group) that are arranged in the horizontal direction. That is, the width H1 of the opening 34 in the horizontal direction is smaller than the arrangement pitch H2 of the nozzle groups that are formed next to one another in the horizontal direction. Because of the above structure, the recording head 18 according to the present embodiment of the invention ejects ink as waste ink from the nozzles 20 that make up one of the nozzle groups 21K, 21Y, 21M, 21C, and 21LC at each ejecting operation performed during flushing operation. That is, the recording head 18 ejects ink from the nozzles 20 belonging to only one nozzle group that is facing the opening 34 of the flushing box 28 at a time. Ink ejected from this nozzle group passes through the opening 34 to be received by the flushing box 28. Note that no ink is ejected from the nozzles 20 belonging to other nozzle groups that are not facing the opening 34 of the flushing box 28 at this point in time.

A cover mechanism 35 is provided over the flushing box 28. The cover mechanism 35 keeps the inner space of the flushing box 28 in a hermetically sealed state during a time period in which flushing is not performed. The cover mechanism 35 includes a cover member 36 that can move in reciprocating motion between two positions, which are a cover position and a retracted position (i.e., retraction position). The cover position is a position at which the cover member 36 closes the opening 34 of the flushing box 28. The retracted position is a position at which the cover member 36 does/can not close the opening 34. The retracted position is located to the left of the cover position. In addition, the cover mechanism 35 includes a pair of cover guiding members that is not illustrated in the drawing. One of the pair of cover guiding members is provided in front of the cover member 36. The other of the pair of cover guiding members is provided behind the cover member 36. The cover guiding members are configured to guide the cover member 36 from the cover position to the retracted position and from the retracted position to the cover position to ensure smooth movement of the cover member 36 while not allowing the cover member 36 to move in the anteroposterior direction.

The cover member 36 includes a member body 37, which has the shape of a flat plate. In addition, the cover member 36 includes a portion to which motive power can be transmitted, which is hereinafter referred to as "motive-power-transmitted portion" and denoted as 38. The motive-power-transmitted portion 38 is erected at the right end of the member body 37. The motive-power-transmitted portion 38 is a member portion with which the left side of the recording head 18 can be brought into contact. A first spring 39 is provided between the left sidewall 12*a* of the frame 12 and the motive-power-transmitted portion 38 of the cover member 36. The first spring 39 is fixed to the inner wall surface of the left sidewall 12*a* of the frame 12. The first spring 39 applies a rightward urging force to the motive-power-transmitted portion 38. The first spring 39 is an example of an urging section according to an aspect of the invention. In a state in which the recording head 18, which is mounted on the carriage 15, is not in contact with the motive-power-transmitted portion 38, the cover member 36 is positioned at the cover position due to an urging force that is applied by the first spring 37. In addition, the cover member 36 is configured in such a manner that the motive-power-transmitted portion 38 thereof is always not in contact with the recording head 18 when the carriage 15 is positioned at any area other than the flushing area in the horizontal direction.

Figure 5:
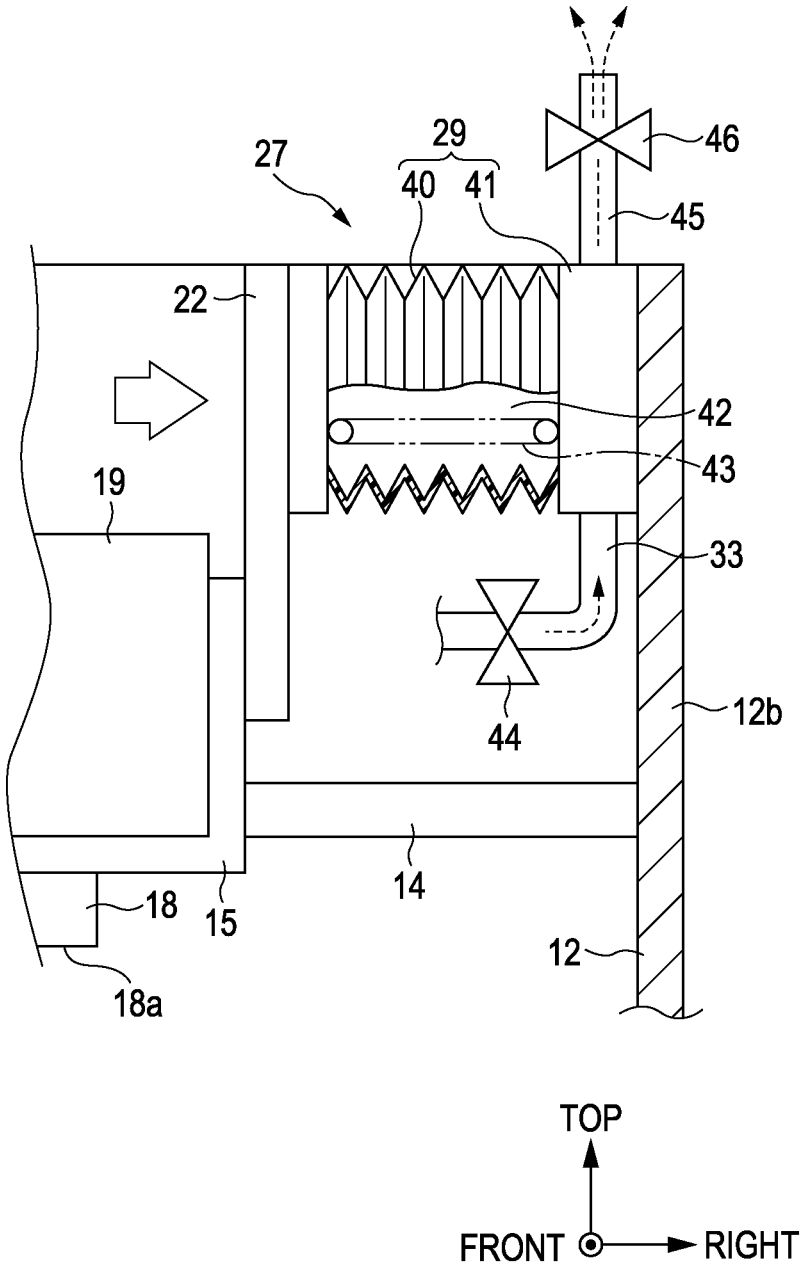
FIG. 5 is a diagram that schematically illustrates, in a partial and sectional view, an example of pressing operation in which an expandable and contractible member is pressed by a carriage according to an exemplary embodiment of the invention.

The pump unit 29 is a so-called bellows pump. As illustrated in FIG. 5, the pump unit 29 includes the aforementioned expandable and contractible member 40 and a lid member 41. The expandable and contractible member 40 is a cylindrical member having an accordion-type foldable circumferential wall and a bottom. The material of the expandable and contractible member 40 is synthetic resin. The lid member 41 seals the open end (the left end in FIG. 5) of the expandable and contractible member 40. The lid member 41 is fixed to the inner wall surface of the right sidewall 12*b* of the frame 12 by means of a fixation member that is not illustrated in the drawing. Therefore, the frame 12 supports the pump unit 29. The left end of the pump unit 29 is always located to the right of the right edge of a sheet of recording paper P that is place on the platen 13. With such a structure, it is possible to avoid the pressing member 22 provided on the carriage 15 from being brought into contact with the pump unit 29 during the printing of an image on the sheet of recording paper P.

A pump chamber 42 is formed inside the expandable and contractible member 40. A second spring 43 is provided inside the pump chamber 42. The second spring 40 applies a leftward urging force to the left end of the expandable and contractible member 40, that is, to the bottom wall of the expandable and contractible member 40. When the carriage 15 moves toward the home position, the pressing member 22 provided on the carriage 15 presses the expandable and contractible member 40 to the right. As a result, the expandable and contractible member 40 contracts against an urging force that is applied by the second spring 43. When the carriage 15 moves away from the home position, the expandable and contractible member 40 expands to the left due to an urging force that is applied by the second spring 43.

An air inlet port and an air outlet port are formed through the lid member 41. The air inlet port is an intake port through which air flows into the pump chamber 42. The air inlet port is not illustrated in the drawing. Air flows out of the pump chamber 42 through the air outlet port, which is also not illustrated in the drawing. The base end of the suction tube 33, which is connected to the flushing box 28, is connected to the air inlet port of the lid member 41. As explained earlier, the tip of the suction tube 33 is positioned inside the flushing box 28. A first one-way valve 44 is provided at an intermediate position on the suction tube 33. The first one-way valve 44 allows air to pass through only in the direction from the flushing box 28 toward the pump unit 29. On the other hand, the base end of an air release tube 45 is connected to the air outlet port of the lid member 41. The tip of the air release tube 45 is positioned outside the expandable and contractible member 40. In the present embodiment of the invention, the tip of the air release tube 45 is exposed to the outside of the frame 12. A second one-way valve 46 is provided at an intermediate position on the air release tube 45. The second one-way valve 46 allows air to pass through only in the direction from the pump unit 29 to the outside.

When the expandable and contractible member 40 of the pump unit 29 having the configuration explained above expands from its contracted state, air that is present inside the flushing box 28 is sucked out of the flushing box 28 into the pump chamber 42 through the suction tube 33. Thereafter, when the expandable and contractible member 40 contracts, the air that was sucked into the pump chamber 42 is discharged to the outside through the air release tube 45. Accordingly, in the present embodiment of the invention, the pump unit 29, the suction tube 33, the air release tube 45, the first one-way valve 44, and the second one-way valve 46 make up a negative pressure generating section according to an aspect of the invention, which generates negative pressure inside the flushing box 28 when the cover member 36 is positioned at (e.g., lies at) the cover position. Note that the timing belt 16 and the driving pulley 16*a* are not shown in FIG. 5 to simplify illustration and facilitate the understanding of the above part of description in this specification.

Next, the operation of the ink-jet printer 11 according to the present embodiment of the invention is explained below with a focus on flushing operation that is performed during the printing of an image on a sheet of recording paper P. The aforementioned paper-feeding mechanism that is not illustrated in the drawing transports a sheet of recording paper P to feed it onto the platen 13. After the feeding of the recording paper P onto the platen 13, the recording head 18 ejects ink from the nozzles 20 toward the recording paper P while traveling in the horizontal direction together with the carriage 15. When the carriage 15 moves in the horizontal direction to an area that is located at the side opposite to the side where the flushing box 28 is provided, or simply said, when the carriage 15 moves to the right area, the pressing member 22 provided on the carriage 15 applies a rightward pressing force to the expandable and contractible member 40. When the pressing member 22 presses the expandable and contractible member 40 to the right, the expandable and contractible member 40 contracts. As a result, air is pumped out of the pump chamber 42, which is formed inside the expandable and contractible member 40, to the outside through the air release tube 45.

Thereafter, when the carriage 15 moves away from the pump unit 29 in the horizontal direction, that is, to the left, the expandable and contractible member 40 expands due to an urging force that is applied by the second spring 43. As the expandable and contractible member 40 expands, the capacity of the pump chamber 42 formed inside the expandable and contractible member 40 increases. Therefore, air that is present inside the flushing box 28 is sucked out of the flushing box 28 into the pump chamber 42 through the suction tube 33, which is the tube through which the pump chamber 42 is in communication with the flushing box 28. Since the communication hole 32 is formed above the upper surface of the ink absorbent material 30, almost no ink absorbed by the ink absorbent material 30 is sucked together with air into the pump chamber 42 through the suction tube 33. Because of suction, negative pressure is generated inside the flushing box 28 that is in a hermetically sealed state with its opening 34 being closed by the cover member 36. As explained above, the expandable and contractible member 40 expands and contracts when the carriage 15 moves away from and toward the pump unit 29. At each expanding and contracting operation, the internal negative pressure of the flushing box 28 accumulates and thus increases. Herein, the term "negative pressure"

means pressure that is lower than (i.e., pressure value that is smaller than) atmospheric pressure. When "negative pressure increases", it means that pressure is reduced to a greater degree. When "negative pressure decreases", it means that pressure increases to approach atmospheric pressure.

For the purpose of performing flushing operation, the recording head 18 moves together with the carriage 15 toward the flushing area. Accordingly, the recording head 18 is brought into contact with the motive-power-transmitted portion 38 of the cover member 36. A leftward pressing force is applied from the recording head 18 to the motive-power-transmitted portion 38. Since the cover member 36 is pressed to the left, it moves toward the retracted position against an urging force that is applied by the first spring 37. As the recording head 18 moves deeper into the flushing area, the cover member 36 is pressed to move from the cover position toward the retracted position. As a result, the opening 34 of the flushing box 28 is uncovered. The group of black ink nozzles 21K, which is located at the leftmost line position among the line positions of the nozzle groups 21K, 21Y, 21M, 21C, and 21LC of the recording head 18, reaches the same position as the position of the opening 34 in the horizontal direction (refer to FIG. 3). In a state in which the group of black ink nozzles 21K faces the opening 34, ink is ejected from the nozzles 20 thereof as waste ink. The ejected ink passes through the opening 34 to be received by the flushing box 28, the internal pressure of which is negative. The ink absorbent material 30 provided inside the flushing box 28 absorbs the ink droplets caught by the flushing box 28. Before absorption by the ink absorbent material 30 inside the flushing box 28, a part of an ink droplet discharged is sometimes formed into mist particles inside the flushing box 28. However, since the internal pressure of the flushing box 28 is lower than pressure outside the flushing box 28, it is possible to prevent such misty ink (which may be referred to as "ink mist") from floating out of the flushing box 28 through the opening 34. Ink mist is sometimes formed not only inside the flushing box 28 but also outside the flushing box 28. Even in such a case, a part of ink mist that is formed outside the flushing box 28, or more specifically, a mist part that is present at and/or around the flushing area, is sucked into the flushing box 28 through the opening 34.

Note that air flows into the flushing box 28 from the outside through the opening 34, which is currently not closed by the cover member 36. For this reason, negative pressure accumulated inside the flushing box 28 gradually decreases. However, since the area size of the opening 34 according to the present embodiment of the invention corresponds to one nozzle group, unlike an opening whose area size is substantially equal to the area size of the entire nozzle formation surface 18*a* of the recording head 18, air does not easily flow into the flushing box 28 from the outside through the opening 34. Therefore, the internal negative pressure of the flushing box 28 does not decrease sharply. That is, the opening 34 according to the present embodiment of the invention functions as flow passage resistance against the flowing of air into the flushing box 28 from the outside.

After the completion of ejection of ink from the nozzles 20 of the group of black ink nozzles 21K, the recording head 18 moves further to the left together with the carriage 15. As a result, the group of yellow ink nozzles 21Y, which is the second nozzle group from the left, reaches the position where it faces the opening 34 of the flushing box 28. In this state, ink is ejected from the nozzles 20 of the group of yellow ink nozzles 21Y as waste ink (refer to FIG. 4). The ejected ink and outside ink mist passes through the opening 34 to enter the flushing box 28. The ink absorbent material 30 provided inside the flushing box 28 absorbs them.

That is, during flushing operation, as the recording head 18 moves to the left, a single nozzle group that faces the opening 34 of the flushing box 28 is changed in a sequential manner, which means that the nozzle groups 21K, 21Y, 21M, 21C, and 21LC are positioned to face the opening 34 sequentially. The recording head 18 ejects ink from the nozzles 20 belonging to only one nozzle group that is facing the opening 34 at a time. In other words, in the present embodiment of the invention, flushing operation is performed sequentially for the nozzle groups 21K, 21Y, 21M, 21C, and 21LC. When the ejection of ink from the nozzles 20 belong to the group of light cyan ink nozzles 21LC, which is located at the rightmost line position among the line positions of the nozzle groups 21K, 21Y, 21M, 21C, and 21LC of the recording head 18, into the flushing box 28 has completed, the leftward movement of the recording head 18 stops. Since the size of the flushing box 28 is substantially larger than that of the opening 34, the internal pressure of the flushing box 28 is still kept in a negative state even at this point in time, that is, lower than outside pressure. For this reason, even in a state in which the opening 34 is exposed (i.e., open) during flushing operation, it is possible to prevent or reduce the floating of ink mist inside and outside the flushing box 28.

After the flushing operation, the recording head 18 moves together with the carriage 15 to a printing area, which is located to the right of the flushing area, for the purpose of ejecting ink onto a sheet of recording paper P. As the recording head 18 moves to the right, the cover member 36 moves from the retracted position to the cover position due to an urging force that is applied by the first spring 37. As a result, the cover member 36 closes the opening 34 of the flushing box 28. Therefore, it is possible to prevent ink mist from floating out of the flushing box 28 through the opening 34 during a time period in which flushing is not performed.

As explained in detail above, the present embodiment of the invention offers the following advantages.

(1) The cover member 36 closes the opening 34 of the flushing box 28 during a time period in which flushing is not performed. In addition, the internal pressure of the flushing box 28 becomes negative due to the operation of the pump unit 29 during non-flushing operation. That is, when the pump unit 29 operates, the cover member 36 prevents air from flowing into the flushing box 28 from the outside through the opening 34. Therefore, in comparison with a case where the pump unit 29 operates with the opening 34 not being closed by the cover member 36, it is easier to accumulate negative pressure inside the flushing box 28; in addition, it is possible to reduce the burden of the pump unit 29.

(2) During flushing operation, when the recording head 18 moves into the flushing area, the cover member 36 is pressed to move from the cover position toward the retracted position. In a state in which the cover member 36 has been retracted, the recording head 18 ejects ink as waste ink. The ejected ink passes through the opening 34 to be received by the flushing box 28. When the waste ink is ejected, the internal pressure of the flushing box 28 is lower than pressure outside the flushing box 28 as a result of the operation of the pump unit 29, which was performed during a time period in which the cover member 36 is positioned at the cover position. For this reason, it is possible to prevent or reduce the floating of ink mist that formed inside and outside the flushing box 28. Therefore, it is possible to prevent the inner surface of the frame 12 and the recording paper P fed into the frame 12 from being stained by ink mist.

(3) The area size of the opening 34 corresponds to each of the nozzle groups 21K, 21Y, 21M, 21C, and 21LC (i.e., one group) of the recording head 18. Therefore, in comparison with an opening whose area size corresponds to all of the nozzles 20 of the recording head 18, it is harder for air to flow into the flushing box 28 that is in a negative pressure state from the outside through the opening 34. For this reason, it is easier to keep the internal pressure of the flushing box 28 lower than outside pressure during flushing operation even without activating the pump unit 29 during a time period in which the opening 34 is exposed. Therefore, although the pump unit 29 does not operate during a time period in which the opening 34 is open, it is possible to prevent ink mist from floating out of the flushing box 28 through the opening 34 in the course of flushing. In addition, it is possible to suck at least a part of ink mist that is formed and present outside the flushing box 28 into the flushing box 28 through the opening 34.

(4) In the present embodiment of the invention, flushing operation is performed sequentially for the nozzle groups 21K, 21Y, 21M, 21C, and 21LC that are arranged in the horizontal direction. The opening 34 functions as flow passage resistance against the flowing of air into the flushing box 28 from the outside. Therefore, it is possible to keep the internal pressure of the flushing box 28 lower than outside pressure (i.e., atmospheric pressure) till the completion of flushing operation for all of the nozzle groups 21K, 21Y, 21M, 21C, and 21LC.

(5) The pump unit 29 operates in accordance with the movement of the carriage 15 during a time period in which flushing is not performed. That is, a driving source that supplies power for moving the carriage 15 in the horizontal direction, that is, the carriage motor 17, functions also as a driving source that supplies power for actuating the pump unit 29. Therefore, it is not necessary to provide another driving source that is not the same as the driving source for the movement of the carriage 15 as the driving source for the operation of the pump unit 29. Since an additional driving source is not necessary, it is possible to avoid an increase in the number of parts (i.e., parts count) of the printer 11.

(6) If the pump unit 29 and the flushing box 28 were provided at the same position in the horizontal direction, it would be necessary to provide a mechanism for stopping the operation of the pump unit 29 when the recording head 18 is brought into contact with the motive-power-transmitted portion 38 of the cover member 36, which would make the structure of the pump unit 29 more complex. In addition, it would be necessary to configure the expandable and contractible member 40 as a member that has a greater length in the expanding and contracting direction than that of the present embodiment of the invention so as to cause the pump unit 29 to operate during non-flushing operation. In such a configuration, during flushing operation, since it is necessary for the carriage 15 or the recording head 18 to press not only the cover member 36 but also the expandable and contractible member 40 of the pump unit 29, the burden of the carriage 15 would be inevitably heavy. In contrast, in the present embodiment of the invention, since the pump unit 29 is provided inside the frame 12 at the side opposite to the side where the flushing box 28 is provided, the configuration (structure) of the pump unit 29 can be simplified. In addition, it is possible to avoid an increase in the size of the pump unit 29. Moreover, it is possible to avoid an increase in the burden of the carriage 15 during flushing operation.

(7) The first spring 39 applies a rightward urging force to the motive-power-transmitted portion 38 of the cover member 36. Therefore, when the recording head 18 moves together with the carriage 15 away from the flushing area to the right, the cover member 36 can move quickly to the cover position due to an urging force that is applied by the first spring 37. Therefore, it is possible to close the opening 34 of the flushing box 28 immediately upon the completion of flushing operation by means of the cover member 36 and to prevent ink mist from floating out of the flushing box 28 through the opening 34.

(8) The communication hole 32 is formed through a sidewall of the flushing box 28 above the ink absorbent material 30. Therefore, unlike a structure in which the communication hole 32 is formed at a position below the ink absorbent material 30, it is possible to avoid ink absorbed by the ink absorbent material 30 from being sucked out of the flushing box 28 through the suction tube 33. Moreover, in comparison with such a structure in which the communication hole 32 is formed at a position below the ink absorbent material 30, it is possible to reduce the internal pressure of the flushing box 28 more efficiently.

The foregoing exemplary embodiment of the invention may be modified as follows.

As a modification example of the foregoing exemplary embodiment of the invention, the left side of the carriage 15 instead of the recording head 18 may be brought into contact with the motive-power-transmitted portion 38 of the cover member 36 during flushing operation. Such a modified configuration offers the same advantages as those of the foregoing exemplary embodiment of the invention.

As a modification example of the foregoing exemplary embodiment of the invention, the cover mechanism 35 may include a first magnet, a second magnet, and a stopper. The first magnet is provided on at least one of the carriage 15 and the recording head 18. The second magnet is provided on the cover member 36. The second magnet is provided in such a manner that the first magnet moved to the flushing area can be brought into contact with the second magnet. The stopper prevents the cover member 36 from moving beyond the cover position to the right. In such a modified configuration, it is preferable that the second magnet should be magnetized (i.e., polarized) in such a manner that the second magnet can be attracted by a magnetic force to the first magnet. With the above configuration, when the recording head 18 moves into the flushing area, the cover member 36 is pressed to move from the cover position toward the retracted position. When the recording head 18 moves away from the flushing area to the right, the cover member 36 moves from the retracted position to the cover position due to a magnetic force that is generated between the first magnet and the second magnet in addition to an urging force that is applied by the first spring 37.

If the magnetic force that is generated between the first magnet and the second magnet is sufficiently large, the first spring 39 may be omitted. In this case, it is preferable that the second magnet should be an electromagnet.

As a modification example of the foregoing exemplary embodiment of the invention, the cover mechanism 35 may include a driving source that supplies power for moving the cover member 36 between the cover position and the retracted position. In such a modified configuration, it is preferable that the driving source should operate in accordance with, for example, in synchronization with, the movement of the carriage 15 into the flushing area during flushing operation.

As a modification example of the foregoing exemplary embodiment of the invention, the pump unit 29 may be configured in such a manner that the expandable and contractible member 40 contracts when the recording head 18 ejects ink toward the right edge region of a sheet of recording paper P.

However, it is preferable that the pump unit 29 should be provided in such a manner that the movement of the recording head 18 to the home position is not obstructed.

As a modification example of the foregoing exemplary embodiment of the invention, the pump unit 29 may generate negative pressure inside the flushing box 28 as driven by a dedicated driving source, which is provided exclusively for the pump unit 29. With such a modified configuration, it is possible to render the internal pressure of the flushing box 28 negative without fault while the cover member 36 closes the opening 34.

As a modification example of the foregoing exemplary embodiment of the invention, the area size of the opening 34 of the flushing box 28 may correspond to two nozzle groups that are arranged next to each other in the horizontal direction. With such a modified configuration, it is possible to eject ink as waste ink from the nozzles 20 belonging to two nozzle groups at a time.

In the foregoing embodiment of the invention, it is illustrated that the number of nozzle line(s) included in each of the nozzle groups 21K, 21Y, 21M, 21C, and 21LC is one. However, the scope of the invention is not limited to such an exemplary configuration. That is, the number of nozzle lines included in each of the nozzle groups 21K, 21Y, 21M, 21C, and 21LC is arbitrary, which may be two, for example. The arbitrary number of nozzle lines included in each of the nozzle groups 21K, 21Y, 21M, 21C, and 21LC are arranged in the horizontal direction. In such a modified configuration, the area size of the opening 34 of the flushing box 28 may correspond to each (i.e., one) nozzle line. Flushing is performed for one nozzle after another if so configured.

As a modification example of the foregoing exemplary embodiment of the invention, an air-permeable film that allows air to pass through but does not allow liquid to pass through may be provided at the open end of the suction tube 33 that is inserted in the flushing box 28. With such a modified configuration, it is possible to prevent liquid (which encompasses ink) contained in the flushing box 28 from flowing into the pump chamber 42 through the suction tube 33 and to prevent the inner wall of the suction tube 33 from being stained by ink. Therefore, it is possible to prevent the suction tube 33 from getting clogged because of the solidification of ink inside the suction tube 33 and to avoid a decrease in the suction efficiency of the pump unit 29 when air is sucked out of the flushing box 28.

As a modification example of the foregoing exemplary embodiment of the invention, a fluid ejecting apparatus according an aspect of the invention may be embodied as a so-called full line printer, which is equipped with a full line head (the recording head 18) that extends throughout the entire width of a sheet of recording paper P in a direction (i.e., the horizontal direction) that is orthogonal to the transportation direction (i.e., "from-back-to-front" direction) of the recording paper P. In such a modified configuration, a fluid catching section according to an aspect of the invention may be moved to a position close to the recording head 18 for flushing with its opening being closed by a cover member. Then, flushing may be carried out after the movement of the cover member to a retracted position in a state in which the fluid catching section is set close to the recording head 18. After the completion of flushing, the cover member may be moved to a cover position so as to close the opening. Thereafter, the fluid catching section may be moved away from the recording head 18.

In the foregoing embodiment of the invention, a fluid ejecting apparatus according an aspect of the invention is embodied as the ink-jet printer 11. However, the scope of the invention is not limited to such an example. The invention is applicable to a variety of fluid ejecting apparatuses that eject or discharge various kinds of fluid that includes ink but not limited thereto. The invention is further applicable to a fluid ejecting apparatus that ejects a liquid/liquefied matter/material that is made as a result of dispersion or mixture of particles of functional material(s) into/with liquid. The invention is further applicable to a fluid ejecting apparatus that ejects a gel substance. The invention is further applicable to a fluid ejecting apparatus that ejects a solid or semi-solid substance that can be ejected as a fluid. It should be noted that the scope of the invention is not limited to those enumerated above. In addition to an ink-jet recording apparatus described in the foregoing exemplary embodiment of the invention, a fluid ejecting apparatuses to which the invention is applicable encompasses a wide variety of other types of apparatuses that ejects liquid or fluid in which, for example, a color material (pixel material) or an electrode material is dispersed or dissolved, though not necessarily limited thereto. Herein, the color material may be, for example, one that is used in the production of color filters for a liquid crystal display device or the like. The electrode material (i.e., conductive paste) may be, though not limited thereto, one that is used for electrode formation of an organic EL display device, a surface/plane emission display device (FED), and the like. A fluid ejecting apparatus to which the invention is applicable further encompasses a wide variety of other types of apparatuses such as one that ejects a living organic material used for production of biochips or one that is provided with a sample ejection head functioning as a high precision pipette and ejects liquid as a sample therefrom. In addition, the invention is applicable to, and thus can be embodied as, a liquid ejecting apparatus that ejects, with high precision, lubricating oil onto a precision instrument and equipment including but not limited to a watch and a camera. Moreover, the invention is applicable to and thus can be embodied as a liquid ejecting apparatus that ejects liquid of a transparent resin such as an ultraviolet ray curing resin or the like onto a substrate so as to form a micro hemispherical lens (optical lens) that is used in an optical communication element or the like. Furthermore, the invention is applicable to and thus can be embodied as a liquid ejecting apparatus that ejects an etchant such as acid or alkali that is used for the etching of a substrate or the like. In addition, the invention is applicable to and thus can be embodied as a fluid ejecting apparatus that ejects a gel fluid (e.g., physical gel). Moreover, the invention is applicable to and thus can be embodied as a dry-jet type (i.e., powder-ejecting type) ejecting apparatus that ejects various kinds of solid such as powder or a granular matter/material. An example of such a dry-jet type ejecting apparatus is a toner-ejecting apparatus employed in a toner jet recording apparatus. The application scope of the invention is not limited to those enumerated or explained above. The invention can be applied to various fluid ejecting apparatuses that eject or discharge various kinds of liquid. In the description of this specification, the term "fluid" is defined as a broad generic concept that encompasses a variety of fluid matter/material/substance that includes but not limited to liquid matter/material/substance. Only one exception thereof is "gas-only" fluid (i.e., fluid that is made up of gas only). For example, the fluid includes, without any limitation thereto, inorganic solvent, organic solvent, solution, liquid resin, liquid metal (e.g., metal melt). The fluid further includes, without any limitation thereto, any liquid/liquefied matter/material/substance, any fluid matter/material/substance, and any particulate matter/material including but not limited to any powder or a granular matter/material.

The entire disclosure of Japanese Patent Application No. 2009-114701, filed May 11, 2009 is expressly incorporated by reference herein.

What is claimed is:

1. A fluid ejecting apparatus comprising:

a fluid ejecting head that has a nozzle formation surface and ejects fluid from a nozzle that is formed as a hole through the nozzle formation surface;

a fluid catching section that has an opening that faces the nozzle formation surface of the fluid ejecting head at the time of flushing, which is ejection of the fluid from the nozzle of the fluid ejecting head as waste fluid, the fluid catching section receiving the fluid that has been ejected from the nozzle as the waste fluid and enters through the opening;

a cover mechanism that includes a cover member that can move between two positions, which are a cover position and a retracted position, the cover position being a position at which the cover member can close or closes the opening of the fluid catching section, the retracted position being a position at which the cover member can not or does not close the opening during the flushing;

a negative pressure generating section that generates negative pressure inside the fluid catching section when the cover member is positioned at the cover position and when the opening of the fluid catching section does not face the nozzle formation surface of the fluid ejecting head; and a moving section that moves the fluid ejecting head and/or the fluid catching section relative to each other in a direction in which the fluid ejecting head and the fluid catching section approach each other and in a direction in which the fluid ejecting head and the fluid catching section become distanced from each other, wherein the negative pressure generating section is provided at one side in a scan direction of the moving section and the fluid catching section is provided at the other side in the scan direction such that the negative pressure generating section operates to provide negative pressure inside the fluid catching section when the negative pressure generation section is pressed by fluid ejecting head being moved by the moving section.

2. The fluid ejecting apparatus according to claim 1, wherein the fluid ejecting head has a plurality of nozzles formed as holes through the nozzle formation surface, where the plurality of nozzles includes the nozzle mentioned above;

the opening of the fluid catching section is shaped to correspond to not all but some of the nozzles of the fluid ejecting head; and the fluid ejecting head ejects the fluid as the waste fluid not from all nozzles but from nozzles that currently face the opening at the time of the flushing.

3. The fluid ejecting apparatus according to claim 2, wherein the fluid ejecting head has a plurality of nozzle groups each of which is made up of at least one nozzle;

the opening of the fluid catching section is shaped to correspond to not all of the nozzles of the fluid ejecting head but some nozzles that belong to a single nozzle group;

the fluid ejecting head ejects the fluid as the waste fluid not from all of the nozzles of the fluid ejecting head but from nozzles that belong to a nozzle group that currently faces the opening at the time of the flushing;

the moving section moves the fluid ejecting head and/or the fluid catching section relative to each other so as to change the nozzle group that currently faces the opening from one nozzle group to another after the ejection; and the fluid ejecting head ejects the fluid as the waste fluid not from all of the nozzles of the fluid ejecting head but from nozzles that belong to a nozzle group that currently faces the opening after the relative movement for the nozzle group change.

4. The fluid ejecting apparatus according to claim 1, wherein the fluid ejecting head is configured to be moved by the moving section in a predetermined scan direction; and the negative pressure generating section includes a pump unit that operates to generate negative pressure inside the fluid catching section in accordance with the movement of the fluid ejecting head in the predetermined scan direction during a time period in which the flushing is not performed.

5. The fluid ejecting apparatus according to claim 4, wherein the pump unit operates to generate negative pressure inside the fluid catching section when pressed by the fluid ejecting head moving toward the other side in the scan direction during the time period in which the flushing is not performed.

6. A fluid ejecting apparatus comprising:

a fluid ejecting head that has a nozzle formation surface and ejects fluid from a nozzle that is formed as a hole through the nozzle formation surface;

a fluid catching section that has an opening that faces the nozzle formation surface of the fluid ejecting head at the time of flushing, which is ejection of the fluid from the nozzle of the fluid ejecting head as waste fluid, the fluid catching section receiving the fluid that has been ejected from the nozzle as the waste fluid and enters through the opening;

a cover mechanism that includes a cover member that can move between two positions, which are a cover position and a retracted position, the cover position being a position at which the cover member can close or closes the opening of the fluid catching section, the retracted position being a position at which the cover member can not or does not close the opening during the flushing;

a negative pressure generating section that generates negative pressure inside the fluid catching section when the cover member is positioned at the cover position and when the opening of the fluid catching section does not face the nozzle formation surface of the fluid ejecting head; and a moving section that moves the fluid ejecting head and/or the fluid catching section relative to each other in a direction in which the fluid ejecting head and the fluid catching section approach each other and in a direction in which the fluid ejecting head and the fluid catching section become distanced from each other, wherein the fluid ejecting head is configured to be moved by the moving section in a predetermined scan direction;

wherein the negative pressure generating section includes a pump unit that operates to generate negative pressure inside the fluid catching section in accordance with the movement of the fluid ejecting head in the predetermined scan direction during a time period in which the flushing is not performed;

wherein the fluid catching section is provided at one side in the scan direction whereas the pump unit is provided at the other side in the scan direction; and wherein the pump unit operates to generate negative pressure inside the fluid catching section when pressed by the fluid ejecting head moving toward the other side in the scan direction during the time period in which the flushing is not performed.

* * * * *